US005095714A

United States Patent [19]

Adachi et al.

[11] Patent Number: 5,095,714

[45] Date of Patent: Mar. 17, 1992

[54] SURGING PREDICTION DEVICE FOR A CENTRIFUGAL COMPRESSOR

[75] Inventors: Yasunori Adachi, Itami; Tetsuo Oka, Moriguchi, both of Japan

[73] Assignee: Daikin Industries, Ltd., Osaka, Japan

[21] Appl. No.: 631,459

[22] Filed: Dec. 21, 1990

[30] Foreign Application Priority Data

Dec. 25, 1989 [JP] Japan ..... 1-337969
Apr. 5, 1990 [JP] Japan ..... 2-91030
Apr. 5, 1990 [JP] Japan ..... 2-91031

[51] Int. Cl.[5] ..... F25B 41/04

[52] U.S. Cl. ..... 62/197; 415/48; 417/295

[58] Field of Search ..... 415/47–49, 415/17, 129, 130; 417/295; 62/197

[56] References Cited

U.S. PATENT DOCUMENTS 2,696,345 12/1954 Hopper ..... 415/47
2,958,506 11/1960 Chimento ..... 415/17
2,974,482 3/1961 Kelley ..... 415/17 X
3,059,660 10/1962 Dantowitz ..... 415/49 X
3,236,499 2/1966 Chatfield et al. ..... 415/47 X
3,398,932 8/1968 Koeller et al. ..... 415/47
4,228,753 10/1980 Davis et al. ..... 415/48 X
4,502,831 3/1985 Sato et al. ..... 415/17 X
4,749,331 6/1988 Blotenberg ..... 415/47
4,869,642 9/1989 Williamson et al. ..... 415/49 X
4,986,084 1/1991 Beckhusen ..... 62/197

*Primary Examiner*—William E. Tapoicai

[57] ABSTRACT

A surging prediction device for a centrifugal compressor has a differential pressure detector and a controller. The detector detects a differential pressure between a hub side pressure in the vicinity of an inlet or a diffuser in the centrifugal compressor and a shroud side presser in the vicinity of the inlet of the diffuser. The controller compares the detected differential pressure from the detector with a set differential pressure beforehand set so as to be lower than a surging differential pressure between the hub side pressure and the shroud side pressure at an occurrence time of surging, and outputs a surging signal predicting an occurrence of surging when the detected differential pressure becomes higher than the set differential pressure.

9 Claims, 12 Drawing Sheets

SURGING PREDICTION DEVICE FOR A CENTRIFUGAL COMPRESSOR

BACKGROUND OF THE INVENTION

The present invention relates to a surging prediction device for a centrifugal compressor and to a refrigeration apparatus using the surging prediction device.

In the case where there takes place the surging in a centrifugal compressor, there has been conventionally provided an arrangement for detecting this surging and preventing the compressor from surging, for example, by lowering the discharge pressure thereof. The surging detection is effected, for example, by a device shown in a block diagram of FIG. 13 (refer to Japanese Patent Application Publication No. 58-15639). The device is composed of a pressure detector 301 for detecting an abrupt discharge pressure drop connected to the discharge line 302, a surging detection circuit 303 for detecting surging upon receiving an output of the pressure detector 301 when there is an abrupt pressure drop within a predetermined set time, and a surging preventing device 304 operating in response to a signal from the surging detection circuit 303 indicating the occurrence of surging.

However, in the conventional arrangement, since the surging detection is effected by the surging detection circuit 303 based on an abrupt drop of the discharge pressure detected by the pressure detector 301, the detection of surging can be made only after the surging has actually occurred, and it is impossible to control so as to prevent surging before the occurrence thereof. Further, since the discharge pressure varies in a capacity control type centrifugal compressor wherein the capacity control thereof is made possible, there is a problem that the arrangement is not applicable to a capacity control type centrifugal compressor. Furthermore, there is also a problem that the structure of the arrangement is complicated, resulting in a cost increase.

Therefore, there is provided another surging prevention arrangement which has, as shown in FIG. 14, a measuring means 311 for measuring an input power (current) to a motor 312 of a centrifugal compressor 313, and a comparator 314 for comparing an input power or current measured by the measuring means 311 with the reference power or current set based on a predetermined discharge pressure or predetermined volume and discharge pressure and for predicting surging in comparison of the input power (current) with the reference power (current) so as to operate a surging preventing valve 315 (refer to Japanese Utility Model Application Laid-open publication No. 63-31292). More specifically, the arrangement is such that the opening ratio of the suction vane in the centrifugal compressor 313 is detected through the input current to the motor 312, the surging prevention valve 315 which is provided on a bypass line 316 bypassing a pressure reducing valve (not shown) is opened based on the vane opening ratio so as to bypass hot gas through the bypass line 316, whereby the amount of work by the centrifugal compressor 313 is reduced and the apparent volume thereof is increased so as to prevent the surging without stopping the centrifugal compressor 313.

In the surging prevention arrangement, however, although the surging line is predicted through measurement of the input power (current) and the relationship between the input power and the discharge pressure, since the head wherein surging will take place is related not only with the discharge pressure but also with the ratio of the discharge pressure to the suction pressure, namely, the compression ratio, the error will increase when the suction pressure fluctuates. Furthermore, in the case where surging is predicted based on the volume and the discharge pressure, though the change in the volume approximates to the change in the input power (current), since the approximating relationship varies depending on the voltage fluctuations, there is an error developed, resulting in a problem that a correct detection of surging can not be made.

Furthermore, in the case where the adiabatic head (kcal/kg) rises in the centrifugal compressor 313 due to, for instance, the adhesion of scale in the piping of the refrigeration system or mixing of air into the refrigerant circulating the refrigeration system, the regulation of the suction vane opening ratio can not cope with the surging and before the surging prevention valve is operated, the centrifugal compressor 313 may reach the suerging area.

Therefore, in the actual operation , the following procedures are required to prevent the centrifugal compressor 313 from surging.

FIG. 15 shows an occurrence state of surging in a capacity control type centrifugal compressor by taking an adiabatic head (kcal/kg) in the ordinate and a volume ($m^3$/min) in the abscissa. When the centrifugal compressor 313 is set so that the surging prevention valve 315 is opened, for example, at the vane opening ratio of 40%, the adiabatic head may rise to reach a point (P) above the surging line (SL) due to adhesion of scale onto the refrigeration piping. Therefore, in the actual operation it is necessary to set the vane opening ratio wherein the surging prevention valve 315 is opened, for example, at the vane opening ratio of 60%, taking the head rise due to the scale adhesion into consideration.

For this reason, the lower limit of the suction vane opening ratio can not be lowered below 60%, resulting in a problem that the lower operation limit of the capacity control for the compressor 313 becomes higher.

SUMMARY OF THE INVENTION

Accordingly, a first object of the present invention is to provide a surging prediction device which is simple in construction and is capable of correctly predicting the surging before the occurrence thereof irrespective of the mode of capacity control making the discharge volume variable and irrespective of the fluctuations in the discharge pressure.

The inventor of the present invention has discovered that in a centrifugal compressor, as the compressor operation approaches, in the volume-adiabatic head coordinates area, the surging line which is the boundary of the surging area, the flow at the impeller outlet becomes turbulent, namely, a phenomenon that the pressure difference between the axial direction hub side pressure and the axial direction shroud side pressure at the diffuser inlet confronting the impeller outlet increases will take place. In other words, it has been found that when the centrifugal compressor is operated in a condition sufficiently away from the surging line, the flow at the impeller outlet is steady without turbulence, and therefore, the differential pressure between the axial direction hub side pressure and the axial direction shroud side pressure becomes approximately zero, while, as the operating condition approaches the surging line, the differential pressure will increase, namely, there is a correlation between the differential pressure and the surging.

In order to accomplish the above-mentioned first object, the surging prediction device for a centrifugal compressor according to the present invention has been made based on the new finding, and the surging prediction device for a centrifugal compressor according to the present invention comprises, in a centrifugal compressor including an impeller mounted on a shaft and a housing which accommodates the impeller and a diffuser formed so that an inlet of the diffuser confronts an outer periphery of the impeller, a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects a differential pressure therebetween; and a control means which receives a signal representing the detected differential pressure from the differential pressure detection means, and compares the detected differential pressure with a set differential pressure beforehand set so as to be lower than a surging differential pressure between the hub side pressure and the shroud side pressure at an occurrence time of surging, and outputs a surging signal predicting an occurrence of surging when the detected differential pressure becomes higher than the set differential pressure.

When the differential pressure between the hub side pressure and the shroud side pressure on the surging line is obtained by an experiment, the differential pressure remains almost the same, as shown in FIG. 4 showing the relationship between the adiabatic head and the differential pressure, as with 100% capacity, even if the suction vane opening ratio is changed from 10%, 20%, 40%, to 80%, with a differential pressure of 0.28 $kg/cm^2$ being held in the present example.

Therefore, by detecting this differential pressure, it is possible to detect the surging point in accordance with the above-mentioned capacity control, and by setting the set differential pressure, for example, of 0.26 $kg/cm^2$ in the control means so as to be lower than the differential pressure at the occurrence of surging, it is possible to preventively detect the occurrence of surging before the occurrence thereof irrespective of the operating capacity.

Furthermore, since the surging detection is conducted based on the detected differential pressure and the differential pressure on the surging line is not changed by the fluctuations in the suction pressure, the surging prediction device is capable of correctly predicting the occurrence of surging without being affected by the fluctuations in the suction pressure.

A second object of the present invention is to provide a surging prediction device which is simple in construction and capable of correctly predicting the time point when the surging will take place so as to prevent the surging from occurring.

In order to accomplish the second object of the present invention, the surging prediction device for a centrifugal compressor according to the present invention comprises, in a centrifugal compressor including an impeller mounted on a shaft and a housing which accommodates the impeller and a diffuser formed so that an inlet of the diffuser confronts an outer periphery of the impeller, a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects a differential pressure therebetween;

a control means which receives a signal representing the detected differential pressure from the differential pressure detection means, and calculates a pressure gradient with respect to time in the detected differential pressure, and calculates predicted occurrence time of surging based on the pressure gradient, the detected differential pressure and a surging differential pressure between the hub side pressure and the shroud side pressure which is beforehand detected at an occurrence time of surging, and outputs a signal representing the predicted occurrence time of surging; and a display means which receives a signal representing the predicted occurrence time of surging from the control means and displays the predicted occurrence time of surging.

The differential pressure between the shroud side pressure and the hub side pressure in the centrifugal compressor is detected by the differential pressure detection means and inputted into the control means, whereby the gradient of the change in the differential pressure with respect to time is calculated by the control means. The occurrence time of surging is predicted based on the gradient, the detected differential pressure and the surging differential pressure, and the predicted occurrence time of surging is correctly displayed by the display means, so that a surging prevention countermeasure can be carried out based on the predicted occurrence time of surging displayed by the display means. More specifically, the surging in the centrifugal compressor generally takes place when air is mixed into the refrigeration piping, or scales adhere to the refrigeration piping, or the amount of cooling water passing through a condenser of the refrigeration system is reduced. Therefore, the surging can be prevented from occurring through operation of a air-removing pump, removal of scales, or adjustment of the amount of cooling water.

Furthermore, a third object of the present invention is to provide a surging prevention device for a centrifugal compressor which is capable of automatically preventing the surging with a simple construction.

In order to accomplish the third object of the present invention, the surging prevention device according to the present invention comprises, in a centrifugal compressor including an impeller mounted on a shaft, a housing which accommodates the impeller and a diffuser formed so that an inlet of the diffuser confronts the outer periphery of the impeller, suction vanes and a vane opening adjustment mechanism for adjusting the opening ratio of the suction vanes, a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects the differential pressure therebetween; and a control means which receives a signal representing the detected differential pressure from the differential pressure detection means, and compares the detected differential pressure with a set differential pressure beforehand set so as to be lower than a surging differential pressure between the hub side pressure and the shroud side pressure at an occurrence time of surging, and outputs a signal for controlling an opening of the suction vane in an opening direction to the vane opening adjustment mechanism when the detected differential pressure becomes higher than the set differential pressure.

According to the above-described structure, when the centrifugal compressor approaches the surging occurrence area, an operation signal is applied to the vane opening adjustment mechanism from the control means so as to control the suction vanes in the opening direction, and as the suction vanes move in the opening direction, the adiabatic head of the centrifugal compressor departs further from the surging line, whereby the surging of the centrifugal compressor is automatically avoided.

Furthermore, a fourth object of the present invention is to provide a refrigeration apparatus which is capable of correctly detecting the approach to the surging line irrespective of the suction vane opening ratio, capable of bypassing hot gas without being affected by scale adhesion, and capable of expanding the operation lower limit zone by reducing the surging allowance.

In order to accomplish the fourth object of the present invention, in a refrigeration apparatus having a centrifugal compressor including an impeller mounted on a shaft and a housing accommodating the impeller and a diffuser formed so that an inlet of the diffuser confronts an outer periphery of the impeller, a condenser, a pressure reducing means and an evaporator sequentially connected by a refrigerant piping, and a hot gas bypass line having a hot gas bypass valve arranged so as to connect the condenser to the evaporator, the refrigeration apparatus according to the present invention comprises:

a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects the differential pressure therebetween; and a control means which receives a signal representing the detected differential pressure from the differential pressure detection means, and compares the detected differential pressure with a set differential pressure beforehand set so as to be lower than a surging differential pressure between the hub side pressure and the shroud side pressure at an occurrence time of surging, and outputs an operation signal for opening the hot gas bypass valve when the detected differential pressure becomes higher than the set differential pressure.

According to the above-described structure, the differential pressure between the hub side pressure and the shroud side pressure in the centrifugal compressor is detected by the differential pressure detection means, and when the detected differential pressure approaches the surging differential pressure at the occurrence time of surging, that is, the detected differential pressure becomes higher than the set differential pressure, the operation signal is applied to the bypass valve from the control means so as to open the bypass valve, whereby a part of high pressure gas is bypassed to the suction side of the centrifugal compressor bypassing the pressure reducing means so as to reduce the work amount of the compressor and increase the apparent volume thereby to prevent surging. Therefore, in the case of the capacity control operation, since the surging differential pressure at the occurrence of surging is almost constant irrespective of the vane opening ratio, when the set differential pressure is set lower than the surging differential pressure and the operation signal is applied to the hot gas bypass valve from the control means upon the detected differential pressure's reaching the set differential pressure, even in any capacity operation case, namely, irrespective of the vane opening ratio, it is possible to correctly predict the occurrence of surging based on the detected differential pressure and prevent the centrifugal compressor from surging by controlling the hot gas bypass valve before the occurrence of surging. Accordingly, since the allowance for the surging can be reduced whereby the vane opening ratio can be made smaller, resulting in the expansion of the operation lower limit zone.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 9 (*b*) is a block diagram showing an essential portion of the other embodiment;

DETAILED DESCRIPTION OF PREFERRED EMBODIMENTS

Figure 1:
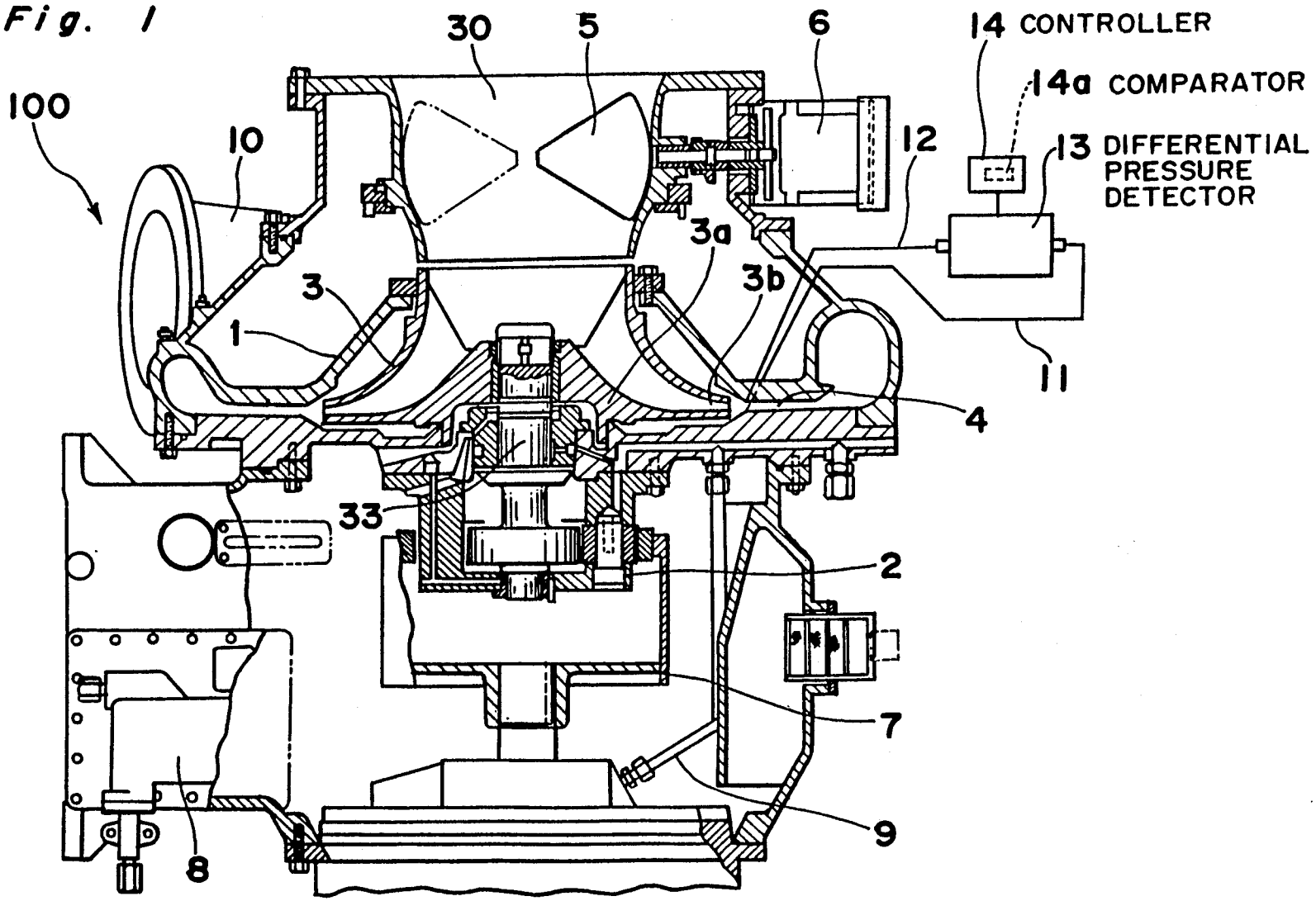
FIG. 1 is a sectional view of a surging prediction device according to a first embodiment of the present invention.

Before the description of the present invention proceeds, it is to be noted that like parts are designated by like reference numerals throughout the accompanying drawings.

A fundamental structure of a centrifugal compressor shown in FIG. 1 is well known and arranged so that an impeller 3 having a hub 3*a* is rotatably mounted on the central portion of a housing 1 through a gear mount assembly interlocking the impeller 3 with a motor (not illustrated), a diffuser 4 having a hub side inlet wall and a shroud side inlet wall is arranged so as to confront the outlet 3*b* of the impeller 3, with a set of guide vanes 5 being installed inside the inlet 3*c* of the impeller 3 so as to control the delivery volume by a motor 6.

Meanwhile, in FIG. 1, a gear coupling 7, a gear pump 8, oil piping 9, and a discharge pipe 10 are operatively connected relative to each other.

Figure 2:
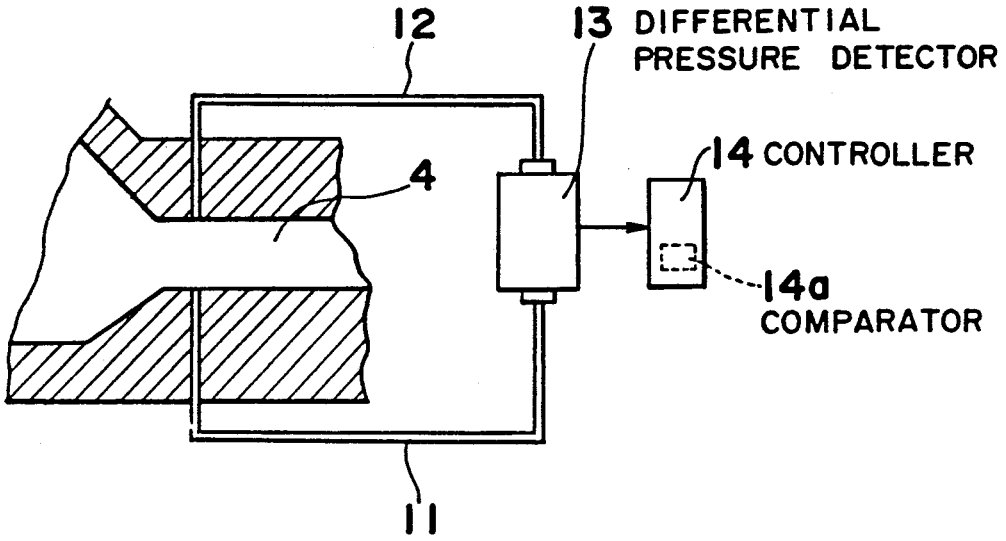
FIG. 2 is a sectional view of an essential portion of the first embodiment shown in FIG. 1.

Further, as shown in FIGS. 1 and 2, there are provided openings near the inlet of the diffuser 4 for a passage feeding the hub side pressure, namely, a hub side conduit pipe 11, and for a passage feeding the shroud side pressure, namely, a shroud side conduit pipe 12 and these conduit pipes 11 and 12 are connected to a differential pressure detector 13 as a differential pressure detection means so as to detect a differential pressure between the hub side pressure and the shroud side pressure. A controller 14 as a control means for outputting a surging signal when the detected differential pressure becomes a set pressure lower than the surging differential pressure at the occurrence of surging is further connected to the differential pressure detector 13.

Based on the surging differential pressure between the hub side pressure and the shroud side pressure on a surging line (SL), that is, the surging differential pressure at the occurrence of surging (in this example, 0.28 kg/cm$^2$), this controller 14 is set at a set differential pressure (0.26 kg/cm$^2$), namely, the reference value, which is somewhat lower than the surging differential pressure (0.28 kg/cm$^2$), and is provided with a comparator 14*a* for comparing the set differential pressure with a detected differential pressure. And the controller 14 is arranged to output a surging signal when the detected differential pressure reaches the set differential pressure.

In the above-described structure, by driving the motor 6 to control the opening ratio of the vane 5, the delivery volume m$^3$/min (discharge volume) is adjusted. This volume decreases, as shown by curves, namely, volume lines in FIG. 3, with the increase in the adiabatic head kcal/kg so as to approach the surging line (SL), and when the volume line crosses the surging line (SL), the surging takes place.

Figure 3:
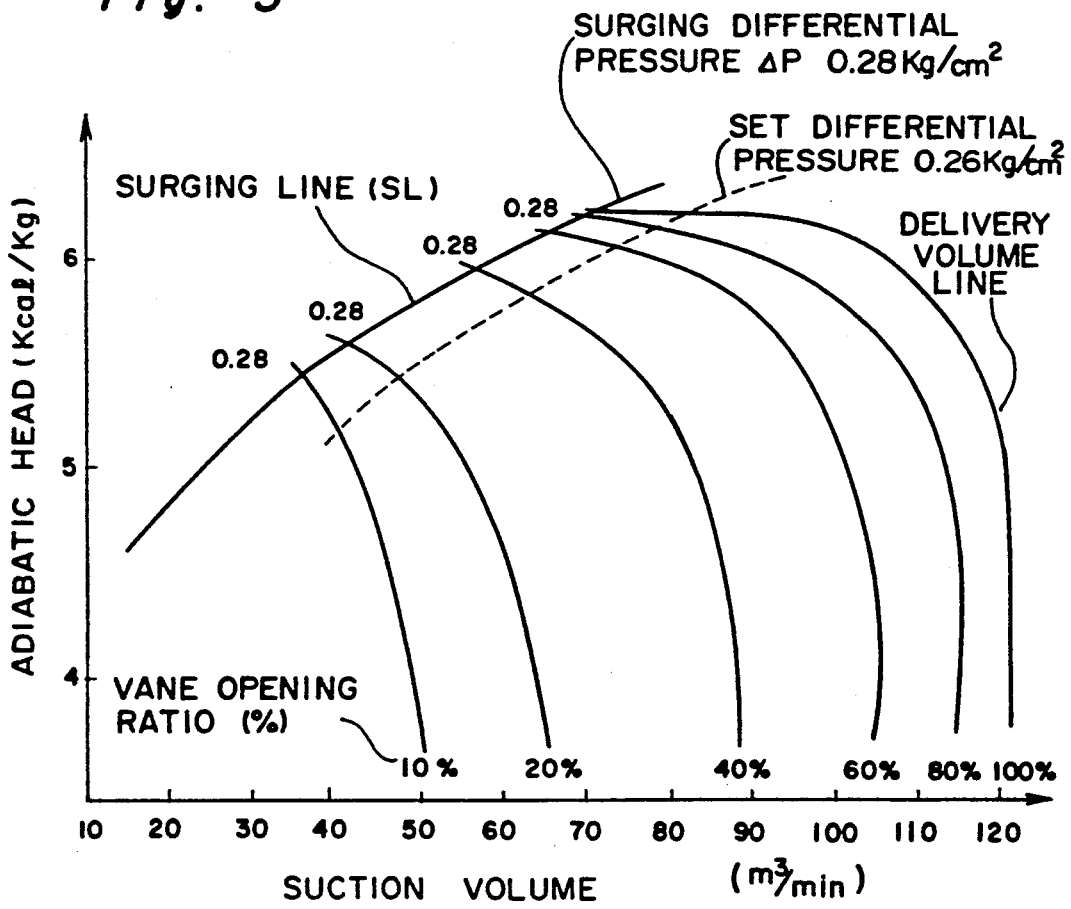
FIG. 3 is a graph showing a relationship between a delivery volume and an adiabatic head.

Meanwhile, the detected differential pressure between the hub side pressure and the shroud side pressure increases as the volume line for each vane opening ratio approaches the surging line (SL), and the surging differential pressure ΔP on the surging line (SL) becomes almost the same differential pressure (in this example, 0.28 kg/cm$^2$) irrespective of the opening ratio of the vane 5, as shown in FIG. 3.

Figure 4:
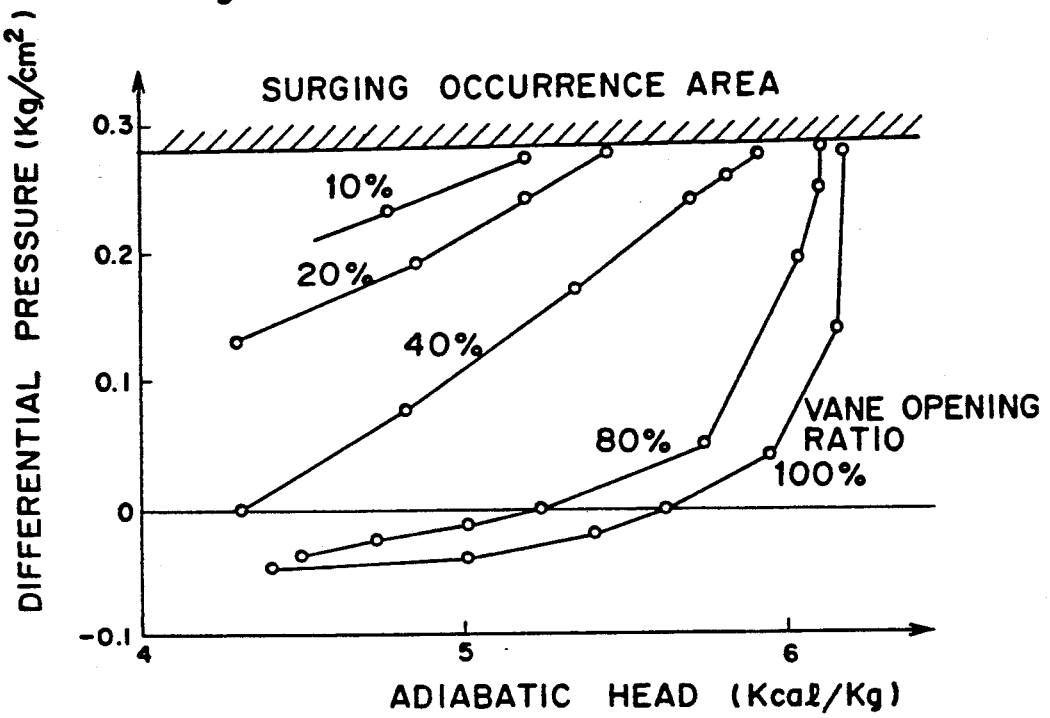
FIGS. 4 and 5 are graphs showing the relationship between the detected differential pressure between the hub side pressure and the shroud side pressure of a diffuser of a centrifugal compressor pressure and the adiabatic head.

More specifically, as shown in FIG. 4, the flow in the inlet portion of the diffuser 4 is distorted with the increase in adiabatic head and the detected differential pressure ΔP between the hub side pressure and the shroud side pressure near the inlet of diffuser 4 is increased. In centrifugal compressors of the same model, although the mode of the increase of the differential pressure ΔP differs in each of the vane openings of 10%, 20%, 40%, 80% and 100%, the differential pressure increases in any case, and the surging takes place above a predetermined differential pressure (0.28 kg/cm$^2$).

Figure 5:
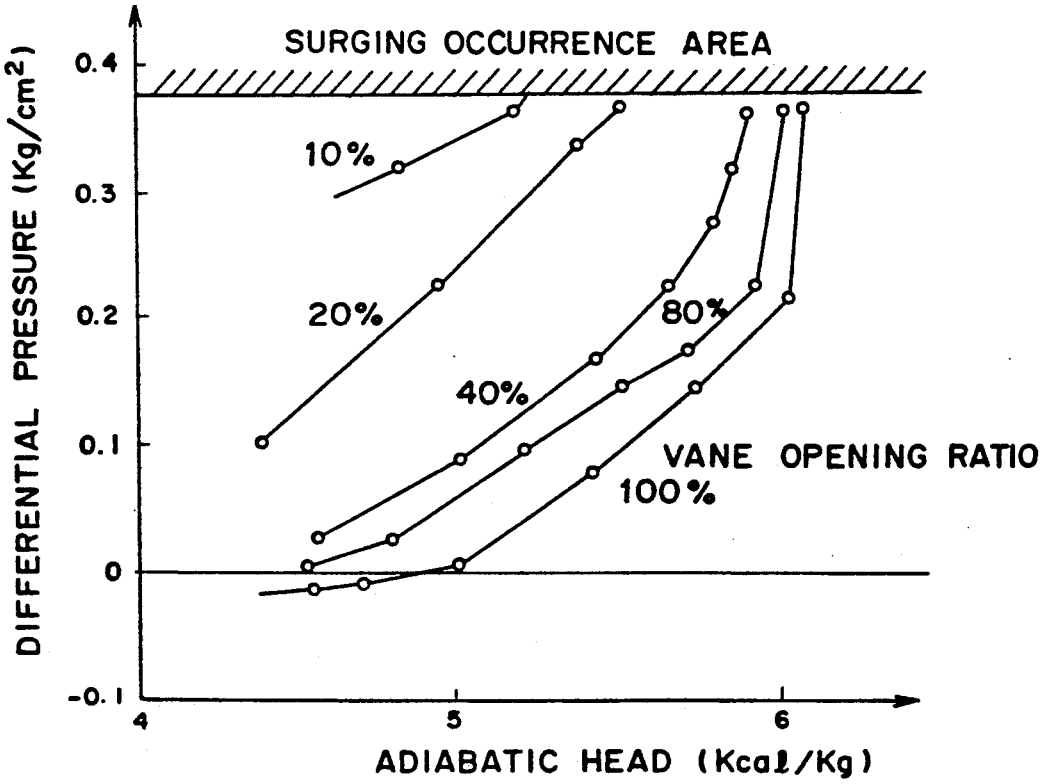

Furthermore, in a centrifugal compressor having, for example, a diffuser of a different shape, the detected differential pressure ΔP increases with the increase in adiabatic head (kcal/kg), as shown in FIG. 5. In this case, the detected differential pressure wherein the surging takes place is 0.38 kg/cm$^2$ and is different from that for the centrifugal compressor as shown in FIG. 4.

Therefore, by obtaining the surging differential pressure (for example, 0.28 kg/cm$^2$ which is shown by a solid line (SL) in FIG. 3) at the occurrence of surging and by setting a set differential pressure (for example, 0.26 kg/cm$^2$ which is shown by a dotted line in FIG. 3) a little lower than the surging differential pressure, it is possible to correctly predict a surging before the occurrence thereof in accordance with the adiabatic head corresponding to the delivery volume irrespective of the vane opening ratio. In other words, since the adiabatic head at which the surging takes place is decreased by the decrease in the delivery volume and the surging line (SL) changes as shown in FIG. 3. Therefore, if an adiabatic head for a particular delivery volume is taken as a set value at which set value the surging does not occur, the surging will take place at the same adiabatic head when the delivery volume is decreased, and the surging can not be prevented. However, by detecting the differential pressure, the surging corresponding to the delivery volume (m$^3$/min) according to a vane opening ratio can be detected, and a surging prediction signal indicating a zone immediately before the occurrence of surging can be outputted in accordance with the delivery volume and adiabatic head on the surging line (SL), whereby it becomes possible to correctly predict the surging in spite of capacity control and securely prevent the surging.

Next, a method for using the surging prediction device of the above-described structure will be explained.

(A) When a surging prediction signal is outputted from the surging prediction device, the centrifugal compressor is stopped to prevent the surging.

Figure 6:
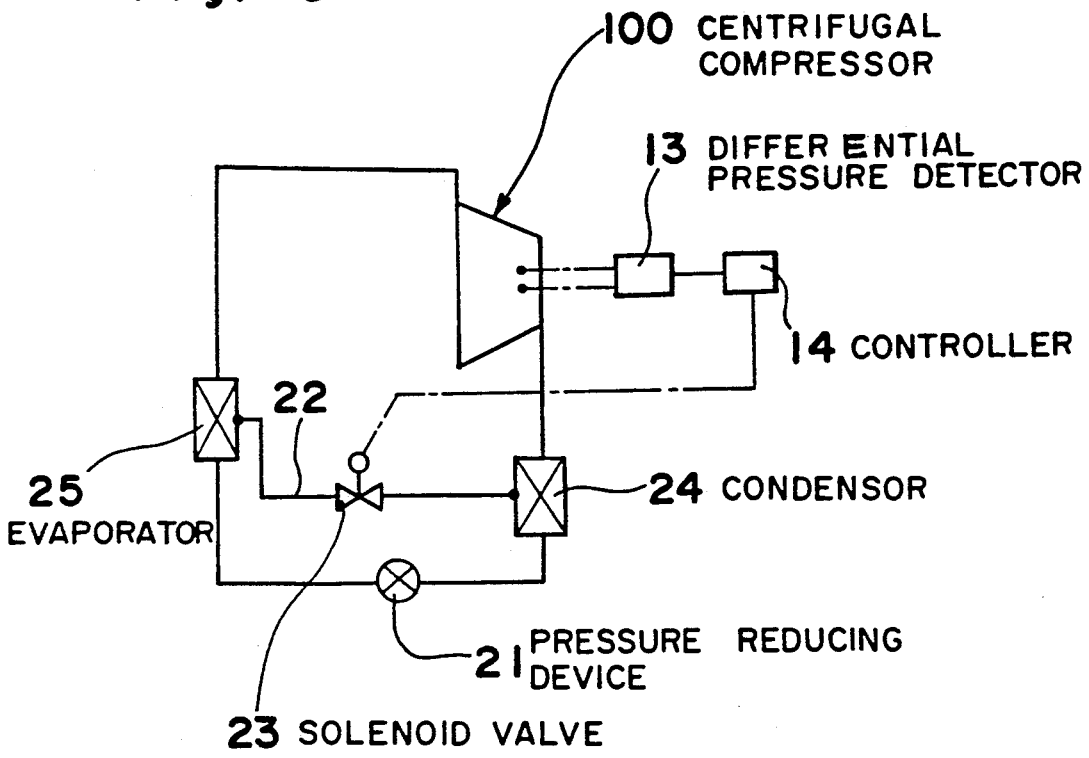
FIG. 6 is a block diagram of a refrigeration apparatus using the above-described surging prediction device.

(B) In the refrigeration circuit including the centrifugal compressor, as shown in FIG. 6, a hot gas bypass line 22 bypassing an expansion valve 21 is provided so as to bypass hot gas by opening a solenoid valve 23 mounted on the bypass line 22 by an output of the surging prediction signal, whereby the work amount of the centrifugal compressor 100 is reduced and the apparent delivery volume is increased and thus the surging is prevented without stopping the centrifugal compressor 20. In FIG. 6, a condenser 24 and an evaporator 25 are operatively provided relative to each other.

(C) The opening of the vanes 5 is controlled in the direction of wider opening based on an output of surging prediction signal so as to prevent the surging without stopping the centrifugal compressor 100. Alternatively, the number of revolutions of the centrifugal compressor 100 may be changed so as to prevent the surging.

(D) A warning buzzer or lamp is actuated based on an output of surging signal.

In this case, as the cause for the occurrence of surging, since there are many cases where air enters the refrigeration cycle system, resulting in increase in the adiabatic head, an air extraction pump is manually operated, or the compressor is manually stopped upon operation of the warning buzzer or lamp.

As described above, since the present invention comprises the differential pressure detector 13 for detecting the differential pressure between the hub side pressure and the shroud side pressure in the vicinity of the inlet of the diffuser 4, and the controller 14 for outputting a surging signal when a detected differential pressure becomes higher than a set pressure set so as to be a little lower than the surging differential pressure at the occurrence of surging, that is, the present invention is arranged to predict the surging point by detecting the differential pressure between the hub side pressure and the shroud side pressure in the vicinity of the inlet of the diffuser, even when the operating capacity is changed, it becomes possible to detect the surging point corresponding to the delivery volume, and therefore, it becomes possible to detect an arbitrary prevention line before the surging irrespective of an operating capacity, to predict with a high accuracy the occurrence of surging, and thereby to certainly prevent the occurrence thereof.

Furthermore, since the differential pressure is not changed by the fluctuations in the suction pressure, it is possible to correctly predict the occurrence of surging without being affected by the suction pressure fluctuation. Moreover, since it is only required to detect the differential pressure between the hub side pressure and the shroud side pressure, the present invention has an advantage that the structure can be simplified.

Figure 7:
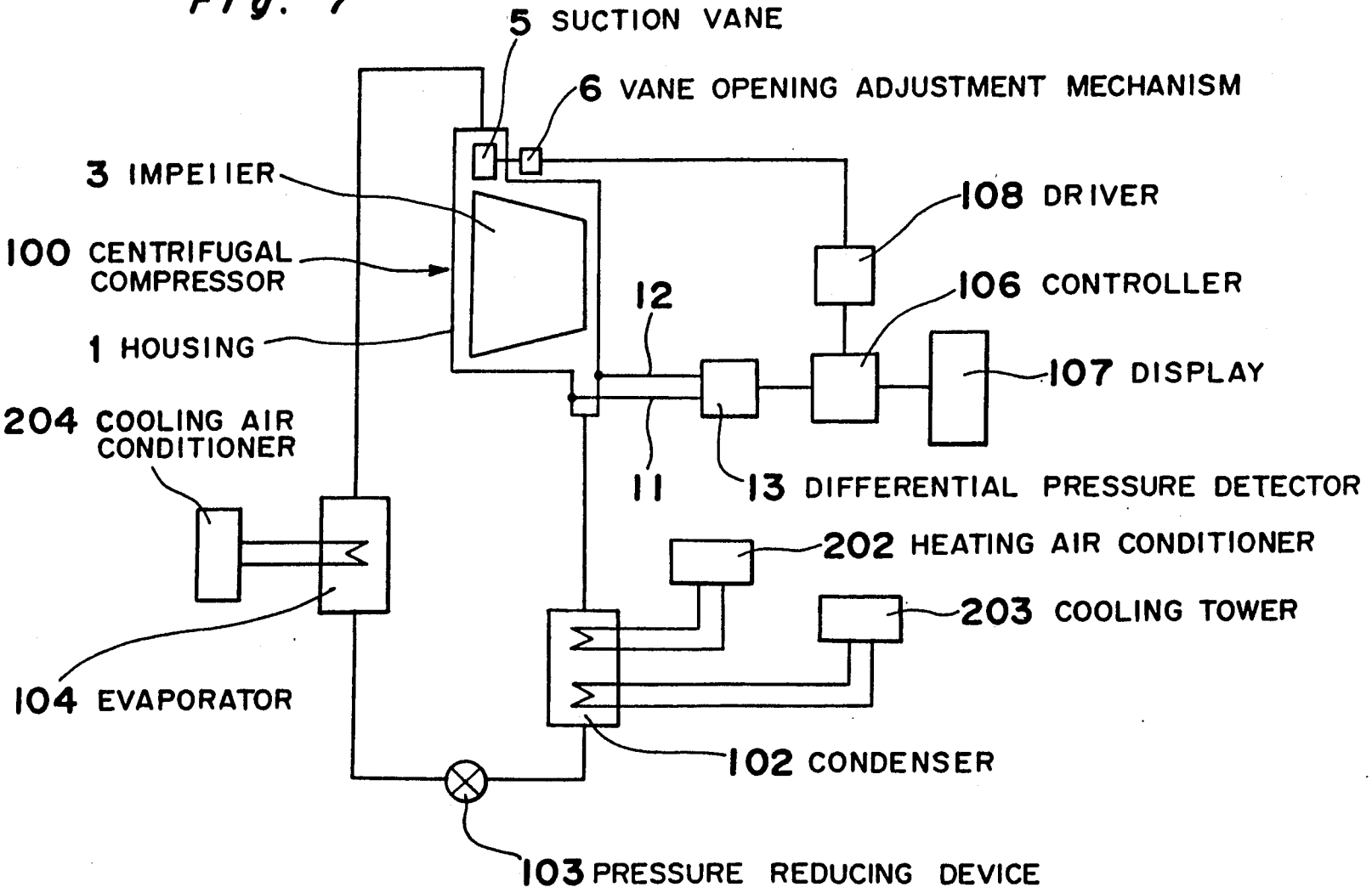
FIG. 7 is a circuit diagram of a refrigeration apparatus using a surging prevention device according to a second embodiment of the present invention.

FIG. 7 shows a refrigeration system employing a centrifugal compressor, in which a centrifugal compressor 100, a condenser 102, a pressure reducing device 103 and an evaporator 104 are sequentially connected through a refrigeration piping. To the condenser 102, a heating air conditioner 202 for making hot water through heat-exchange with the refrigerant passing through the condenser 102, and also a cooling tower 203 for cooling the refrigerant passing through the condenser 102 are connected, while to the evaporator 104, there is connected a cooling air conditioner 204 for producing chilled water through heat exchange with the refrigerant passing through the evaporator 104.

Figure 8:
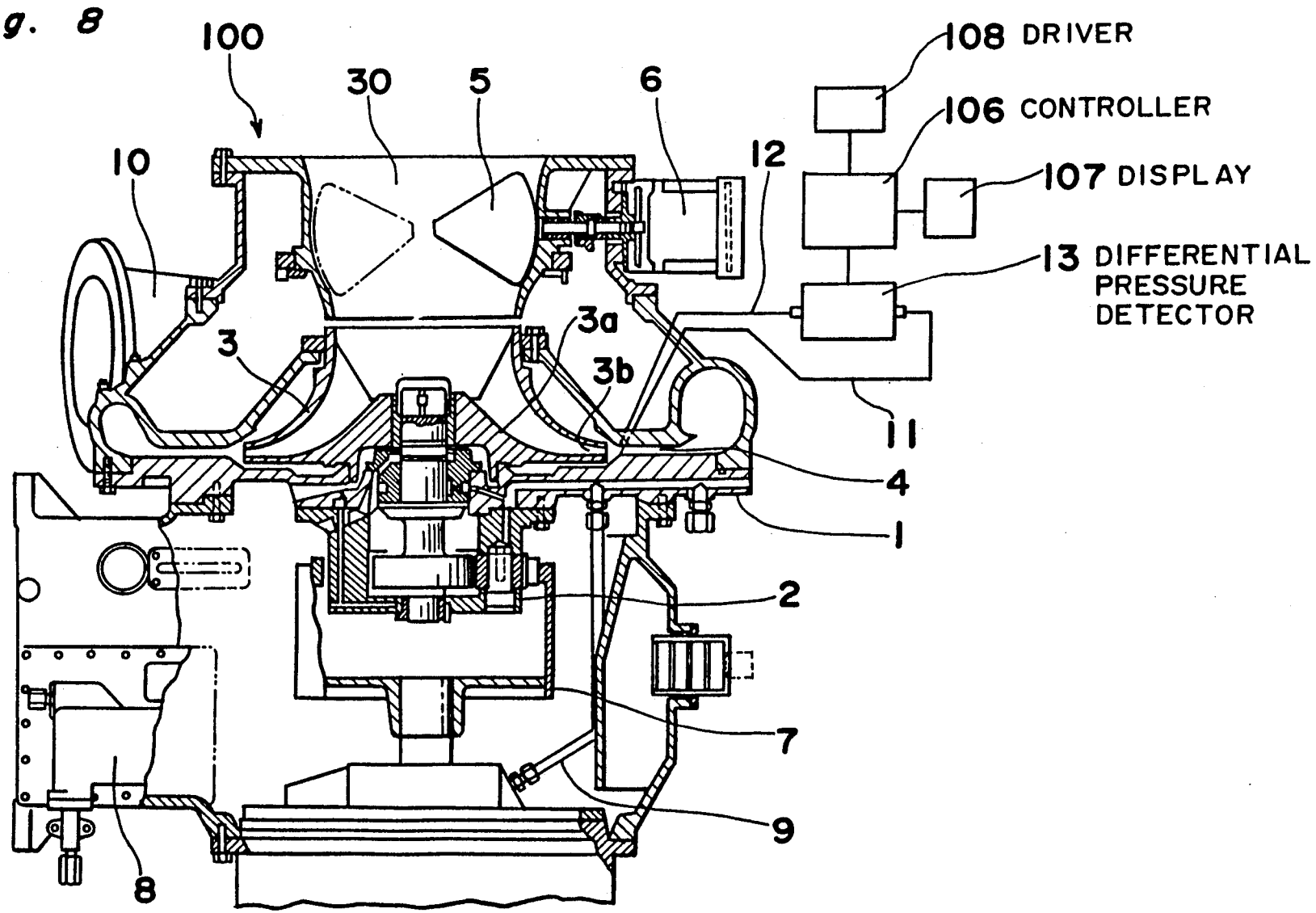
FIG. 8 is a sectional view of a centrifugal compressor according to the second embodiment.

As shown in detail in FIG. 8, an impeller 3 having a hub 3*a* is rotatably supported on the central portion of the housing 1 of the centrifugal compressor 100. The impeller 3 is driven by a gear mount assembly interlocked with a motor (not shown) through a shaft 33, and toward the outlet 3*b* of the impeller 3, a diffuser 14 is arranged, while suction vanes 5 are arranged on the inlet 30 of the housing 1, and the opening of the suction vanes 5 are adjusted by the vane opening adjustment mechanism 6 consisting of a motor, whereby the capacity control operation for the centrifugal compressor 100 may be made possible. In FIG. 8, a gear coupling 7, an oil pump 8, oil piping 9, and a discharge pipe 10 are operatively provided relative to each other.

Figure 9A:
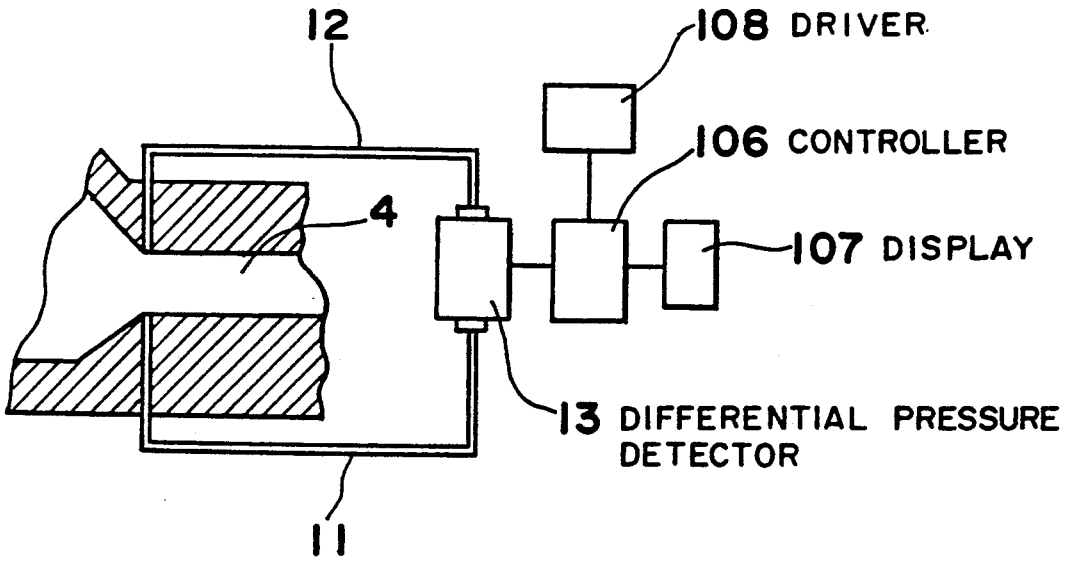
FIG. 9 (*a*) is a block diagram showing an essential portion of the centrifugal compressor according to the second embodiment.
Figure 9B:
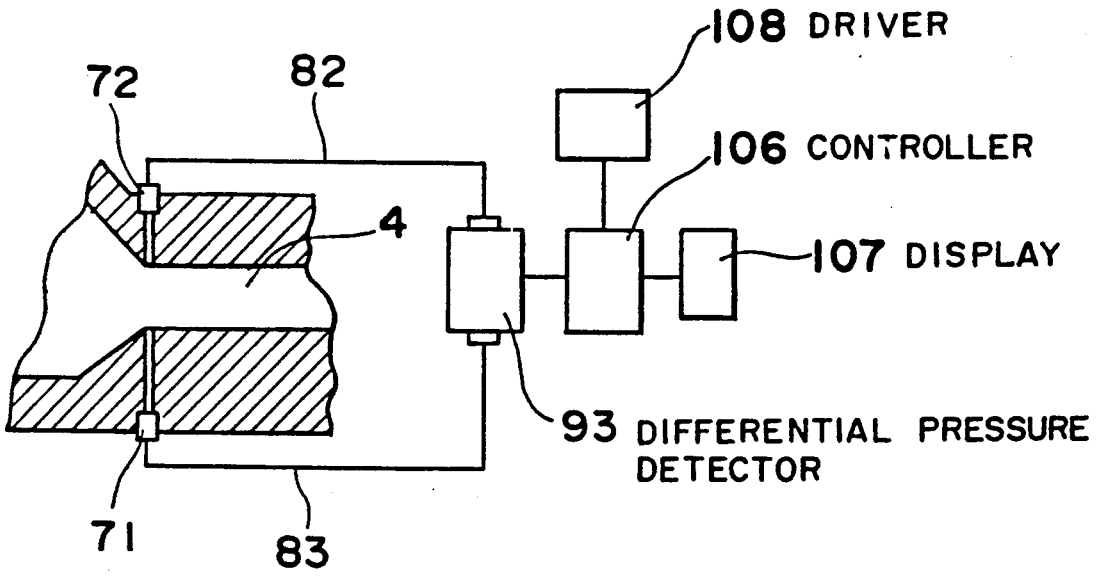

In the above-described refrigeration system employing the centrifugal compressor 100, as shown in detail in FIGS. 8 and 9 (*a*), there are provided near the inlet of the diffuser 4 in the axial direction thereof ports respectively for a hub side conduit pipe 11 a shroud side conduit pipe 12, which respectively communicate the hub side pressure and the shroud side pressure. The respective conduit pipes 11 and 12 are connected to a differential pressure detector 13. The output side of the differential pressure detector 13 is connected to a controller 106. The controller 106 calculates the change in the differential pressure between the hub side pressure and shroud side pressure detected by the detector 13 so as to predict the occurrence time of surging based on the change in the differential pressure. On the output side of the controller 106, there is connected a display 107 for displaying a predicted occurrence time of surging calculated by the controller 106. Based on the predicted occurrence time of surging, a air extraction pump (not shown in figures) is operated to extract air in the refrigeration piping, the scales attached to the refrigeration piping are removed, or further the amount of cooling water from the cooling tower 203 to the condenser 102 is adjusted, whereby the surging is prevented from occurrence thereof.

Furthermore, the controller 106 is connected to a driver 108 which is arranged to output an operation signal to the vane opening adjustment mechanism 6, upon receiving a signal from the controller 106 when the differential pressure between the hub side pressure and the shroud side pressure detected by the differential pressure detector 13 approaches the surging differential pressure for occurrence of surging, so as to forcibly control the opening of the vanes 5 in the opening direction, whereby when the centrifugal compressor 100 approaches the surging occurrence area, the driver 108 outputs to the vane opening adjustment mechanism 6 an operation signal so as to operate the vanes 5 in the opening direction, whereby the adiabatic head of the centrifugal compressor 100 is moved away from the surging line (SL) so as to avoid the surging automatically (see FIG. 3).

FIG. 3 shows a state of surging occurrence of a capacity control type centrifugal compressor with adiabatic head (kcal/kg) being taken on the ordinate and delivery volume ($m^3$/min) being taken on the abscissa. The delivery volume in the centrifugal compressor 100 is controlled by the setting of the opening of the vanes 5, and in the capacity control operation of the compressor 100 corresponding to the setting of the opening of vanes 5, accompanying the adiabatic head increase, the delivery volume line for each of the vane opening settings 10% to 100% approaches the surging line (SL), and when an operation point along the volume line exceeds the surging line (SL), the surging takes place in the centrifugal compressor 100.

Meanwhile, the differential pressure between the hub side pressure and the shroud side pressure increases as the operation point along each volume line approaches the surging line (SL) and the differential pressure on the surging line (SL) becomes almost the same differential pressure (in FIG. 3, 0.28 kg/cm$^2$) irrespective of the vane opening setting.

In other words, as the adiabatic head (kcal/kg) of the centrifugal compressor 100 rises, the flow velocity distribution in the inlet portion of the diffuser 4 becomes non-uniform and thereby the detected differential pressure between the hub side pressure and the shroud side pressure in the vicinity of the inlet thereof increases, and although the changes in the detected differential pressure are different in respective vane opening settings of 10%, 20%, 40%, 80%, and 100%, in the centrifugal compressor of the same model, the differential pressure increases in any vane opening setting and the surging takes place in a area exceeding a predetermined differential pressure (for example, 0.28 kg/cm$^2$).

Furthermore, even in a centrifugal compressor having a diffuser of a different shape, as shown in FIG. 5, the differential pressure corresponding to each vane opening setting increases with the rise in adiabatic head, and the differential pressure for the occurrence of surging is 0.38 kg/cm$^2$ in this case.

Therefore, the differential pressure between the hub side pressure and the shroud side pressure in the diffuser 4 at the occurrence time of surging is beforehand obtained for various kinds of centrifugal compressors so as to be stored in the memory in the controller 106, and the gradient of the differential pressure with respect to time in the diffuser 4 detected by the differential pressure detector 13 is obtained by the controller 106, whereby the predicted surging occurrence time is calculated based on the current and detected differential pressure, the surging differential pressure at the occurrence time of surging, and the gradient, and this predicted occurrence time is displayed on the display 107, and the surging prevention measures are taken based on the display.

Further, the surging differential pressure at the occurrence time of surging is beforehand obtained, and a set differential pressure lower than this surging differential pressure on the surging line (SL) is set. For example, when the surging differential pressure on the surging line (SL) is 0.28 kg/cm$^2$ as shown in FIG. 3, the set differential pressure is 0.26 kg/cm$^2$ as shown by a dotted line in FIG. 3. The controller 106 compares a measured differential pressure between the hub side pressure and the shroud side pressure in the diffuser 4 with the set differential pressure, and when the measured differential pressure reaches the set differential pressure, the driver 108 connected to the controller 106 outputs an operation signal to the vane opening adjustment mechanism 6 so as to forcibly open wider the vanes 5, whereby as is clear from FIG. 3, the adiabatic head of the compressor 100 is moved away further from the surging line (SL) thus to automatically avoid the surging. Further, since the differential pressure on the surging line (SL) is constant regardless of the opening setting of the vane, and the opening wider operation for the vanes 5 is conducted by the controller 106, when the surging line is approached in any capacity control operation, for example, in the case of a capacity control operation of 10% vane opening setting as shown in FIG. 3, the vane wider opening operation is conducted by the controller 106 so as to prevent surging from occurring in the centrifugal compressor 100, and therefore, the continuous operating time for the centrifugal compressor 100 can be elongated.

Figure 10:
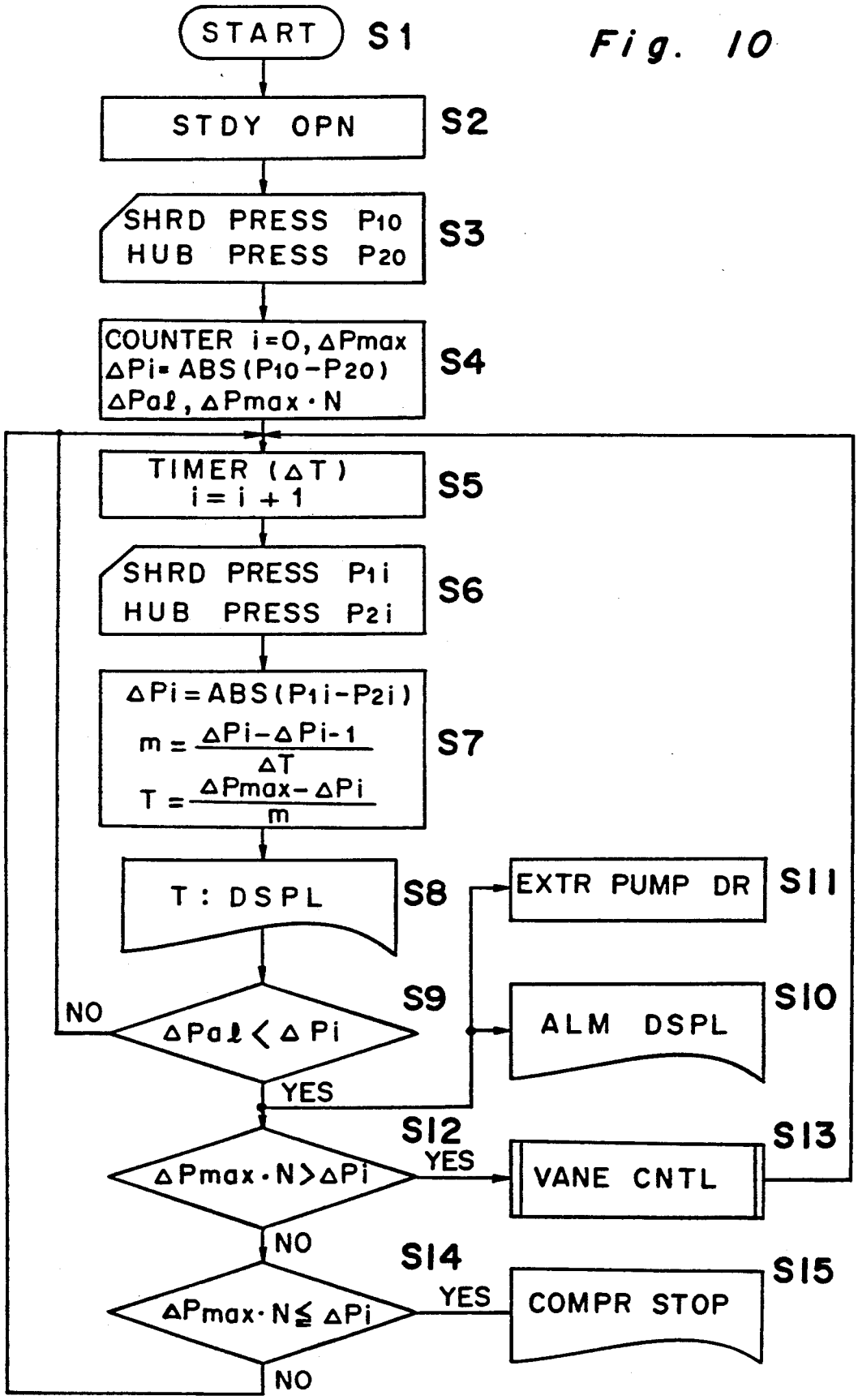
FIG. 10 is a flow-chart showing the control procedure of the second embodiment.

Next, the above operation in the controller 106 will be explained with reference to a flow-chart shown in FIG. 10.

First, in the steady operation (step S2) accompanying a start (step S1), the shroud side pressure $P_{10}$ and the hub side pressure $P_{20}$ are read in by the controller 106 at step S3, and thereafter at step S4, an initial setting is effected. In this setting, counter $i=0$, the surging detected differential pressure on the surging line $\Delta P_{max}$, a differential pressure between the shroud side pressure and the hub side pressure measured at start of the operation $\Delta Pi = ABS$ (absolute value $(P_{10}-P_{20})$, an alarm output differential pressure for outputting an alarm $\Delta P_{al}$, a set differential pressure set so as to be a little lower than the surging differential pressure $\Delta P_{max}$, namely, $\Delta P_{max} \times N$ wherein $N<1$ are inputted. Next, after effecting the initial setting, a time of minute order $\Delta T$ is set by a timer and the counter is set at $i=i+1$ at step S5. Further at step S6, the shroud side pressure $P_{1i}$ and hub side pressure $P_{2i}$ at each time are read in. Thereafter, at step S7, based on the detected differential pressure $\Delta Pi = ABS\ (P_{1i}-P_{2i})$ at each time, the differential pressure change (pressure gradient) $m=(P_{1i}-P_{2i})/\Delta T$ is calculated by the controller 106 and based on this calculation result, the predicted occurrence time of surging $T=(\Delta P_{max}-\Delta Pi)/m$ is calculated and displayed on the display 107 at step S8. Next, at step S9, it is judged whether or not the detected differential pressure $\Delta Pi$ is higher than the alarm output differential pressure $\Delta P_{a1}$ and in the case where it is not higher, the routine from step S5–S8 is repeated, while in the case where it is higher, at step S10, a surging alarm is displayed on the display 107 or other display device, or at step S11, an air extraction pump is driven. Further, in the case where it is higher at step S9, it is judged at step 12 whether or not the detected differential pressure $\Delta Pi$ is lower than the set differential pressure $\Delta P_{max} \times N$, and in the case of "yes", the control of vanes 5 is effected at step S13, while in the case of "no", it is judged at step S14 whether the detected differential pressure $\Delta Pi$ is higher than the set differential pressure $\Delta P_{max} \times N$ or equal, and in the case of "no", the routine from step S5 is repeated, while in the case of "yes", the centrifugal compressor 100 is stopped at step 15 on the judgement that a dangerous area is reached, with the stopping being displayed on the display 107.

Figure 11:
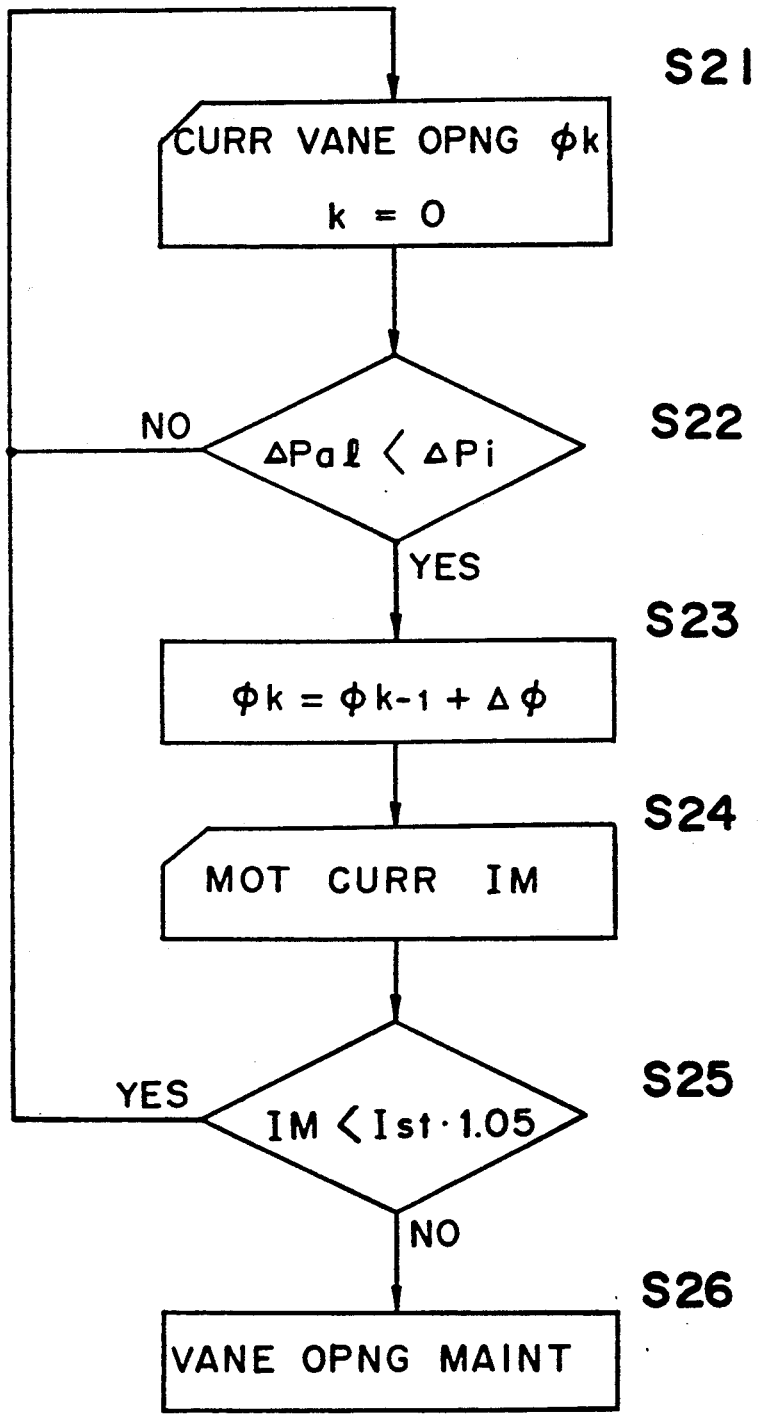
FIG. 11 is a flow-chart showing the sub-routine for controlling the suction vanes.

Furthermore, the vane control at step S13 is effected based on the sub-routine as shown in FIG. 11. More specifically, first at step S21, the current vane opening setting $\phi k$ wherein $k=0$ is read in, and then at step S22, it is judged whether the detected differential pressure $\Delta Pi$ is higher than the alarm output differential pressure $\Delta P_{al}$ or not, and in the case of "no", the routine from the step 21 is repeated, while in the case of "yes", the vane opening setting $\phi k = \phi_{k-1} + \Delta\phi$ (opening setting change amount) is set at step S23, and thereafter, the motor current IM of the centrifugal compressor is read in at step S24, and then, it is judged at step S25 whether the motor current is smaller than the rated current $I_{st}$ multiplied by a factor 1.05 or not, and in the case of "yes", the routine from the step 21 is repeated, while in the case of "no", the vane opening setting at step S25 is maintained at step S26.

As described hereinabove, the surging prevention device according to the present invention comprises a differential pressure detector 13 for detecting the differential pressure between the shroud side pressure and the hub side pressure in a centrifugal compressor 100, a controller 106 for calculating the pressure gradient with respect to time from the detection result of the differential pressure detector 13 and for calculating and predicting the occurrence time of surging based on the pressure gradient, the detected current differential pressure and the surging differential pressure at the occurrence of surging, and a display 107 for displaying the predicted occurrence time of surging calculated by the controller 106. Therefore, it is possible to correctly predict the occurrence of surging in the centrifugal compressor 100 and display the occurrence time on the display 107 for preventing certainly the occurrence of surging based on this display.

Further, the surging prevention device according to the present invention is provided with a vane opening adjustment mechanism 6 for adjusting the suction vane opening setting and a driver 108 which is arranged to output an operation signal to the vane opening adjustment mechanism 6 upon receipt of a signal from the controller 106 when the differential pressure between the shroud side pressure and the hub side pressure approaches the surging differential pressure at the occurrence of surging so as to control the vane opening setting in the wider opening direction. Therefore, when the compressor 100 approaches the surging occurrence area, the vanes are operated in the wider opening direction by the vane opening adjustment mechanism 6 so as to move the adiabatic head in the compressor 100 away from the surging line (SL), whereby the surging of the compressor 100 can be automatically avoided.

Figure 12:
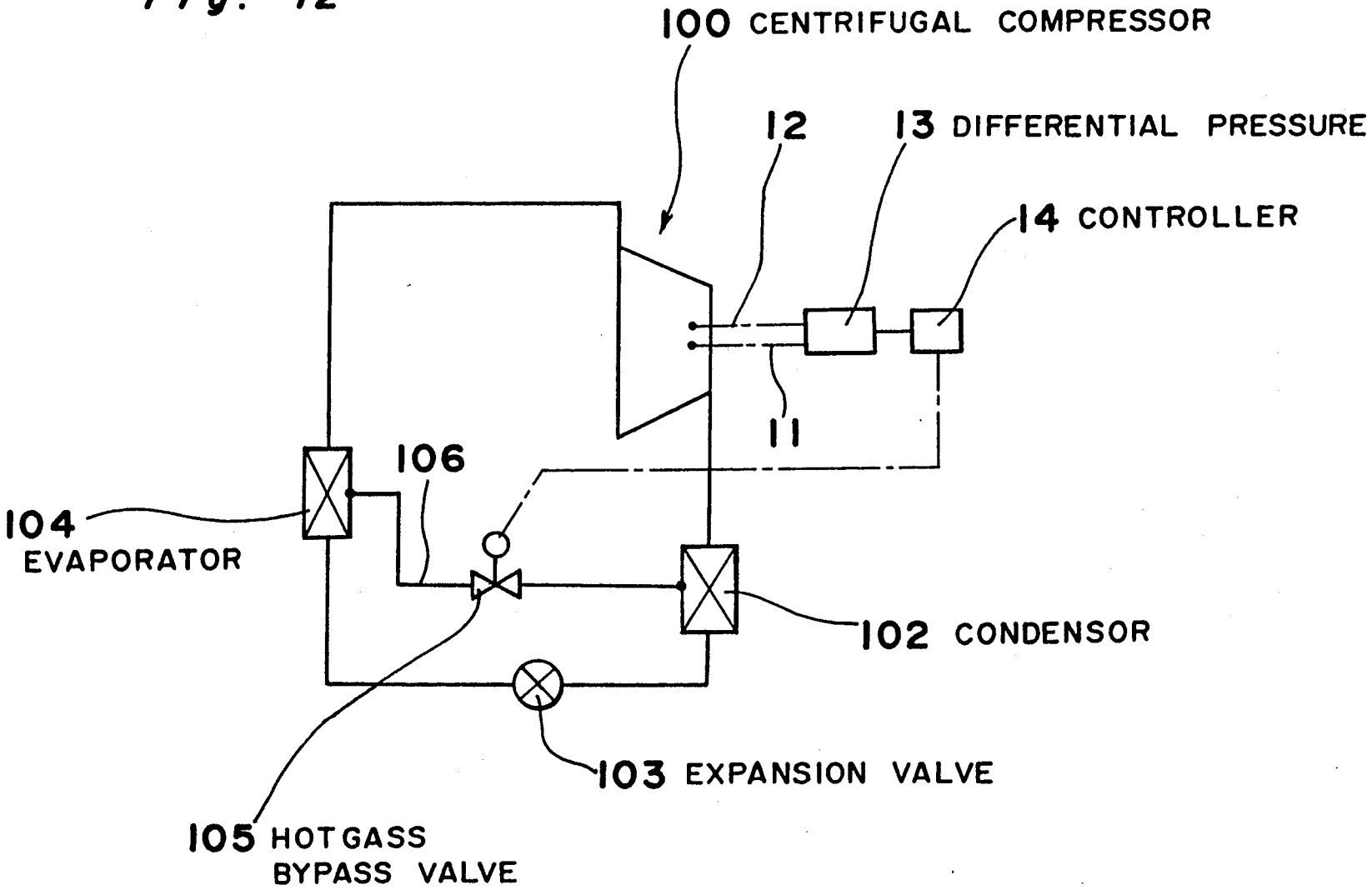
FIG. 12 is a circuit diagram of a refrigeration apparatus according to a third embodiment of the present invention.
Figure 13:
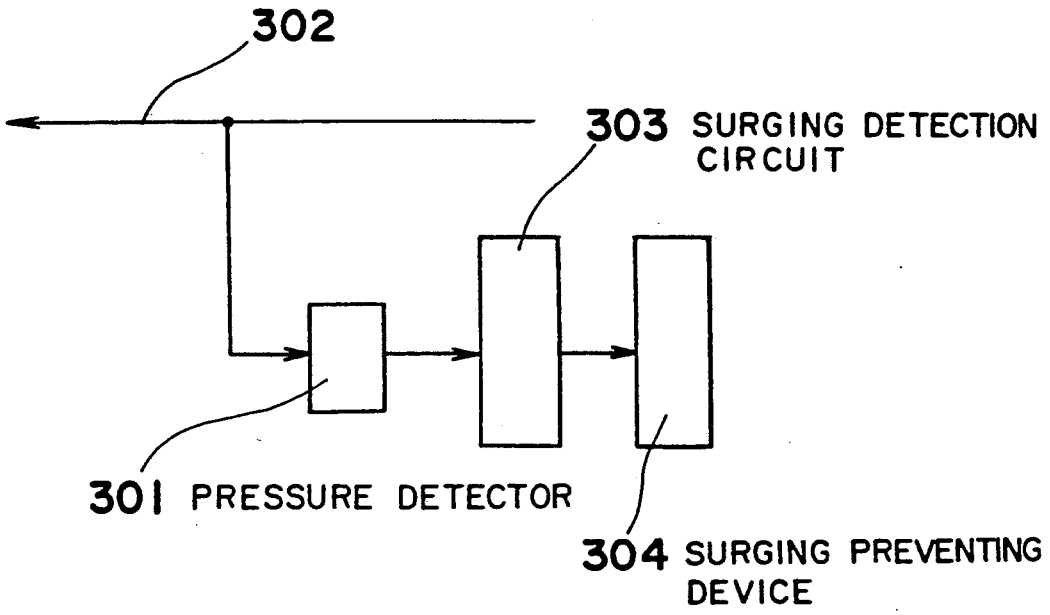
Fig. 13 PRIOR ART
FIG. 13 is a explanatory drawing for a conventional example.
Figure 14:
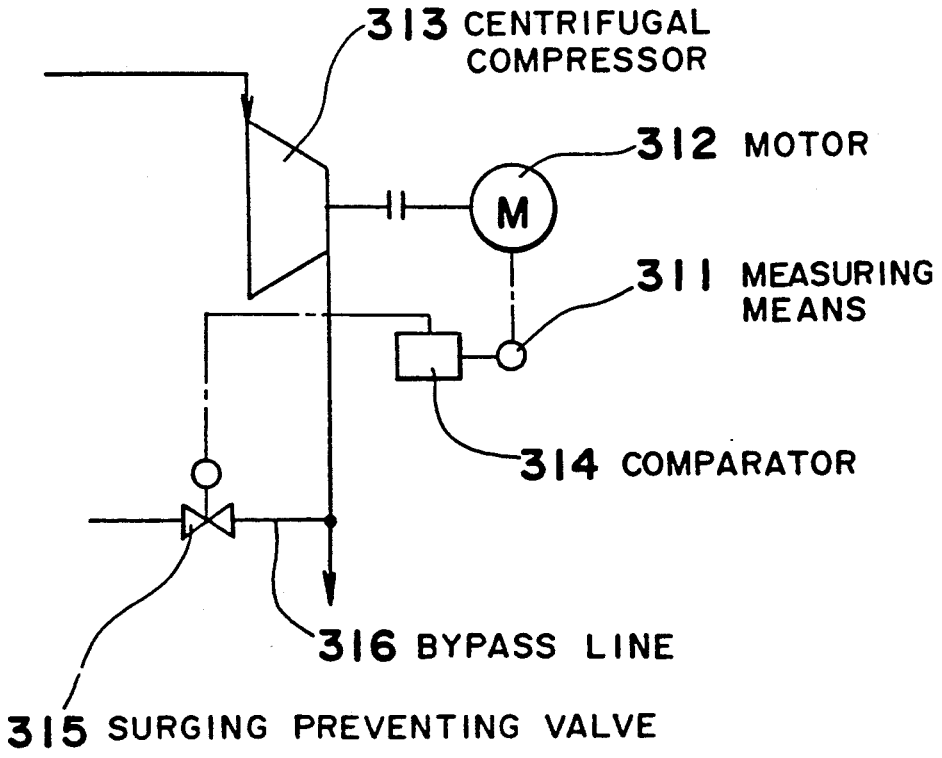
Fig. 14 PRIOR ART
FIG. 14 is a circuit diagram of a conventional refrigeration apparatus.
Figure 15:
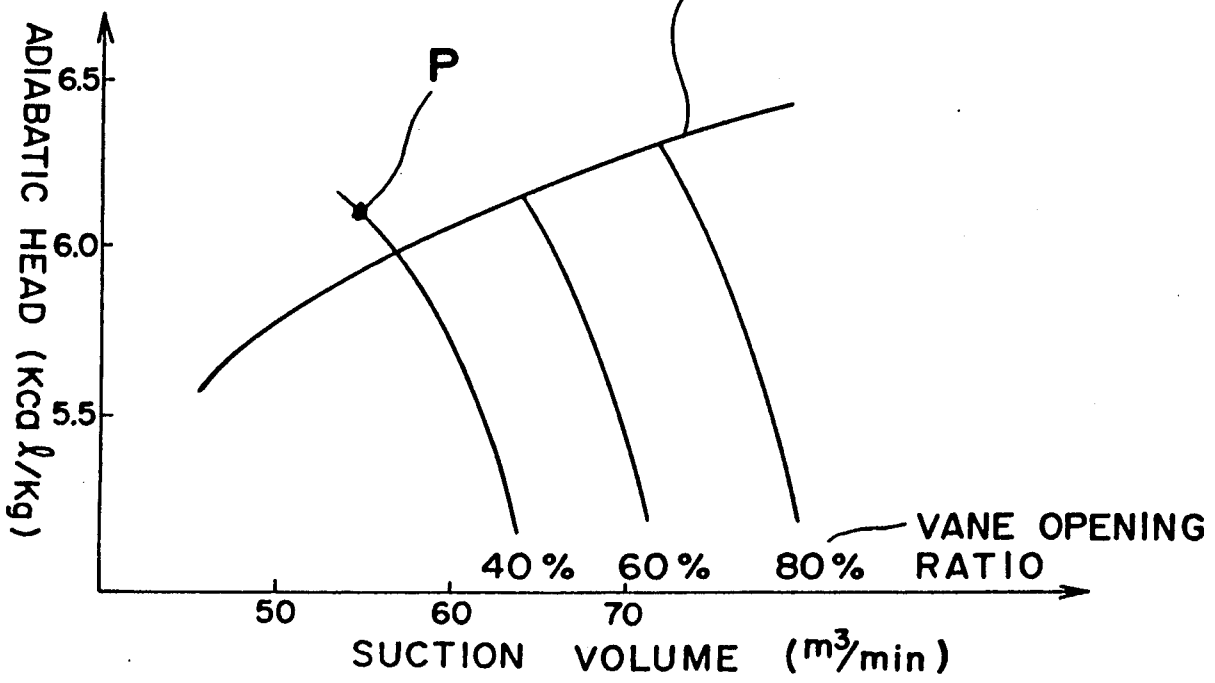
Fig. 15 PRIOR ART
FIG. 15 is a graph showing a relationship between the delivery volume and the adiabatic head for explaining the conventional occurrence state of surging.

FIG. 12 is a block diagram showing a refrigeration system employing a centrifugal compressor 100, in which the centrifugal compressor 100, a condenser 102, an expansion valve 103 and an evaporator 104 are sequentially connected through refrigerant piping, with the outlet side of the evaporator 104 being connected to the suction side of the centrifugal compressor 100. In the high pressure side of the centrifugal compressor 100, that is, between the inlet of the condenser 102 and the inlet of the evaporator 104, there is provided a hot gas bypass line 106 including a hot gas bypass valve 105 so as to supply a part of high pressure gas discharged from the centrifugal compressor 100 to the evaporator 104 by bypassing the expansion valve 103 through the hot gas bypass line 106 by the opening operation of the hot gas bypass valve 105, whereby the work amount of the centrifugal compressor 100 is reduced and thereby the surging is prevented.

The centrifugal compressor 100, differential pressure detector 13 and the controller 14 are constructed as shown in FIGS. 1 and 2.

The controller 14 is connected to the hot gas bypass valve 105. When the differential pressure between the hub side pressure and the shroud side pressure which is detected by the differential pressure detector 13 approaches the surging differential pressure at the occurrence of surging, an operation signal is applied to the hot gas bypass valve 105 from the controller 14 so as to open the hot gas bypass valve 105.

The differential pressure between the hub side pressure and the shroud side pressure at the occurrence of surging in the centrifugal compressor 100 is obtained, and a set differential pressure lower than the differential pressure on the surging line, for example, 0.26 $kg/cm_2$ as shown by a dotted line in FIG. 3 when the differential pressure on the surging line is 0.28 $kg/cm_2$ as shown by a solid line in FIG. 3, is set so as to be compared with the measured differential pressure between the hub side pressure and the shroud side pressure in the diffuser 4 detected by the differential pressure detector 13, and when the measured differential pressure reaches the set differential pressure, a signal is applied from the controller 14 to the hot gas bypass valve 105 so as to open the bypass valve 105 and thereby to prevent surging of the centrifugal compressor 100. Therefore, since the differential pressure on the surging line is almost constant regardless of the opening setting of the vanes 5, and the hot gas bypass valve 105 is controlled based on a set differential pressure lower than the surging differential pressure, in any capacity control operation, for example, even in the case of capacity control operation of 10% vane opening setting, the surging of the centrifugal compressor 100 can be certainly prevented irrespective of the vane opening setting and the continuous operating time of the centrifugal compressor 100 can be elongated. Furthermore, since it is not necessary to make allowances for the effect of adhesion of scale as in the conventional example, the vane opening setting is controllable down to a small opening, and as a result, the lower operating zone of the centrifugal compressor 100 is expanded and a capacity control operation in a wide range becomes possible.

As described hereinabove, in the refrigeration apparatus according to the present invention, a differential pressure detector 13 for detecting the differential pressure between the shroud side pressure and the hub side pressure in the centrifugal compressor 100, and a controller 14 for outputting an operation signal when the differential pressure approaches the surging differential pressure at the occurrence time of surging based on the detection result of the detector 13 are provided and a controller 14 is connected to a hot gas bypass valve 105. Therefore, when the detected differential pressure approaches the surging differential pressure at the occurrence time of surging, the hot gas bypass valve 105 is opened, whereby the surging of the centrifugal compressor 100 can be prevented from occurring without being affected by the adhesion of scale. Furthermore, since the hot gas bypass valve 105 is opened based on the differential pressure irrespective of the vane opening and therefore it is not necessary to make allowances for the effect of the adhesion of scale as in the conventional example, the lower operation limit area can be expanded with the result that a capacity control operation in a wide range is made possible.

FIG. 9 (*b*) shows a block diagram of an essential part of the other embodiment. In FIG. 9 (*b*), a pressure sensor 71 is provided for detecting the pressure of the first wall of the diffuser 4, and a pressure sensor 72 is provided for detecting the pressure on the second wall of the diffuser 4. The pressure detectors 71, 72 are electrically connected to the differential pressure detector 93 through wires 82, 83 respectively. The function of the device in FIG. 9 (*b*) is the same as that in FIG. 9 (*a*), except for the difference between the electrical transmission of the signals representing pressures to the differential pressure detector 93 and the direct transmission of the pressures to the differential pressure detector 13.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a surging prediction device for a centrifugal compressor including an impeller mounted on a shaft and a housing which accommodates the impeller and a diffuser formed so that an inlet of the diffuser confronts an outer periphery of the impeller, the surging prediction device for a centrifugal compressor comprising:

a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects a differential pressure therebetween; and a control means which receives a signal representing the detected differential pressure from the differential pressure detection means, and compares the detected differential pressure with a set differential pressure beforehand set so as to be lower than a surging differential pressure between the hub side pressure and the shroud side pressure at an occurrence time of surging, and outputs a surging signal predicting an occurrence of surging when the detected differential pressure becomes higher than the set differential pressure.

2. The surging prediction device for a centrifugal compressor in accordance with claim 1, wherein the hub side pressure detection means is a conduit passage opened on the first wall of the diffuser, and the shroud side pressure detection means is a conduit passage opened on the second wall of the diffuser, and the differential pressure detection means is a differential pressure detector connected to both the conduit passages.

3. The surging prediction device for a centrifugal compressor in accordance with claim 1, wherein the hub side pressure detection means is a pressure sensor to detect a pressure on the first wall of the diffuser, and the shroud side pressure detection means is a pressure sensor to detect a pressure on the second wall of the diffuser, and the differential pressure detection means is a differential pressure detector electrically connected to both the pressure sensors.

4. In a surging prediction device for a centrifugal compressor including an impeller mounted on a shaft and a housing which accommodates the impeller and a diffuser formed so that an inlet of the diffuser confronts an outer periphery of the impeller, the surging prediction device for a centrifugal compressor comprising:

a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects a differential pressure therebetween;

a control means which receives a signal representing the detected differential pressure from the differential pressure detection means, and calculates a pressure gradient with respect to time in the detected differential pressure, and calculates predicted occurrence time of surging based on the pressure gradient, the detected differential pressure and a surging differential pressure between the hub side pressure and the shroud side pressure which is beforehand detected at an occurrence time of surging, and outputs a signal representing the predicted occurrence time of surging; and a display means which receives a signal representing the predicted occurrence time of surging from the control means and displays the predicted occurrence time of surging.

5. In a surging prevention device for a centrifugal compressor including an impeller mounted on a shaft, a housing which accommodates the impeller and a diffuser formed so that an inlet of the diffuser confronts the outer periphery of the impeller, suction vanes and a vane opening adjustment mechanism for adjusting opening of the suction vanes, the surging prevention device for a centrifugal compressor comprising:

a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects the differential pressure therebetween; and a control means which receives a signal representing the detected differential pressure from the differential pressure detection means, and compares the detected differential pressure with a set differential pressure beforehand set so as to be lower than a surging differential pressure between the hub side pressure and the shroud side pressure at an occurrence time of surging, and outputs a signal for controlling an opening of the suction vanes in opening direction to the vane opening adjustment mechanism when the detected differential pressure becomes higher than the set differential pressure.

6. The surging prevention device for a centrifugal compressor in accordance with claim 5, wherein the control means calculates a pressure gradient with respect to time in the detected differential pressure, and calculates predicted occurrence time of surging based on the pressure gradient, the detected differential pressure and the surging differential pressure between the hub side pressure and the shroud side pressure and outputs a signal representing the predicted occurrence time of surging, and further comprising a display means which receives a signal representing the predicted occurrence time of surging from the control means, and displays the predicted occurrence time of surging.

7. In a refrigeration apparatus having a centrifugal compressor including an impeller mounted on a shaft and a housing accommodating the impeller and a diffuser formed so that an inlet of the diffuser confronts an outer periphery of the impeller, a condenser, a pressure reducing means and an evaporator sequentially connected by a refrigerant piping, and a hot gas bypass line having a hot gas bypass valve arranged so as to connect the condenser to the evaporator, the refrigeration apparatus comprising:

a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects the differential pressure therebetween; and a control means which receives a signal representing the detected differential pressure from the differential pressure detection means, and compares the detected differential pressure with a set differential pressure beforehand set so as to be lower than a surging differential pressure between the hub side pressure and the shroud side pressure at an occurrence time of surging, and outputs an operation signal for opening the hot gas bypass valve when the detected differential pressure becomes higher than the set differential pressure.

8. In a surging prevention device for a centrifugal compressor including an impeller mounted on a shaft, a housing which accommodates the impeller and a diffuser formed so that an inlet of the diffuser confronts the outer periphery of the impeller, suction vanes and a vane opening adjustment mechanism for adjusting opening of the suction vanes, the surging prevention device for a centrifugal compressor comprising:

a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects the differential pressure therebetween; and a control means which receives a signal representing the detected differential pressure from the differential pressure detection means, and compares the detected differential pressure with a set differential pressure beforehand set so as to be lower than a surging differential pressure between the hub side pressure and the shroud side pressure at an occurrence time of surging, and outputs a signal for stopping the centrifugal compressor when the detected differential pressure becomes higher than the set differential pressure.

9. In a surging prevention device for a centrifugal compressor including an impeller mounted on a shaft, a housing which accommodates the impeller and a diffuser formed so that an inlet of the diffuser confronts the outer periphery of the impeller, suction vanes and a vane opening adjustment mechanism for adjusting opening of the suction vanes, the surging prevention device for a centrifugal compressor comprising:

a hub side pressure detection means for detecting a hub side pressure which is a fluid pressure on a first wall of the diffuser in one direction of the shaft in the vicinity of the inlet of the diffuser;

a shroud side pressure detection means for detecting a shroud side pressure which is a fluid pressure on a second wall of the diffuser in the other direction of the shaft in the vicinity of the inlet of the diffuser;

a differential pressure detection means which is connected to the hub side pressure detection means and the shroud side pressure detection means, and detects the differential pressure therebetween; and a control means which receives a signal representing the detected differential pressure from the differential pressure detection means, and compares the detected differential pressure with a predetermined surging differential pressure between the hub side pressure and the shroud side pressure at an occurrence time of surging, and outputs a signal for stopping the centrifugal compressor when the detected differential pressure becomes higher than the predetermined surging differential pressure.

* * * * *